US009526950B2

(12) United States Patent
Ichikawa et al.

(10) Patent No.: US 9,526,950 B2
(45) Date of Patent: Dec. 27, 2016

(54) GOLF BALLS INCLUDING DENSE HIGH ACID LONOMERS

(75) Inventors: Yasushi Ichikawa, Tualatin, OR (US); Thomas J. Kennedy, III, Wilbraham, MA (US)

(73) Assignee: NIKE, Inc., Beaverton, OR (US)

( * ) Notice: Subject to any disclaimer, the term of this patent is extended or adjusted under 35 U.S.C. 154(b) by 304 days.

(21) Appl. No.: 13/433,014

(22) Filed: Mar. 28, 2012

(65) Prior Publication Data

US 2013/0260915 A1 Oct. 3, 2013

(51) Int. Cl.
*A63B 37/06* (2006.01)
*A63B 37/00* (2006.01)

(52) U.S. Cl.
CPC ..... *A63B 37/0092* (2013.01); *A63B 37/0003* (2013.01); *A63B 37/0037* (2013.01); *A63B 37/0044* (2013.01); *A63B 37/0049* (2013.01); *A63B 37/0051* (2013.01); *A63B 37/0062* (2013.01); *A63B 37/0063* (2013.01); *A63B 37/0066* (2013.01); *A63B 37/0069* (2013.01); *A63B 37/0074* (2013.01); *A63B 37/0084* (2013.01); *A63B 37/0096* (2013.01); *A63B 37/0032* (2013.01); *A63B 37/0043* (2013.01); *A63B 37/0047* (2013.01); *A63B 37/0076* (2013.01); *A63B 37/0078* (2013.01); *A63B 37/0086* (2013.01)

(58) Field of Classification Search
CPC ..... A63B 37/0059
USPC ..... 473/377
See application file for complete search history.

(56) References Cited

U.S. PATENT DOCUMENTS

| | | | |
|---|---|---|---|
| 5,688,860 | A | 11/1997 | Croft |
| 5,688,869 | A | 11/1997 | Sullivan |
| 6,719,646 | B2 | 4/2004 | Calabria et al. |
| 6,756,436 | B2 | 6/2004 | Rajagopalan et al. |
| 6,800,695 | B2 | 10/2004 | Sullivan |
| 7,004,856 | B2 | 2/2006 | Sullivan et al. |
| 7,074,138 | B2 | 7/2006 | Kennedy, III |
| 7,163,994 | B2 | 1/2007 | Wu et al. |
| 7,207,903 | B2 | 4/2007 | Sullivan |
| 7,320,649 | B2 | 1/2008 | Rajagopalan et al. |
| 7,402,114 | B2 | 7/2008 | Binette et al. |
| 7,652,086 | B2 | 1/2010 | Sullivan et al. |
| 7,767,759 | B2 | 8/2010 | Kim |
| 7,772,315 | B2 | 8/2010 | Lee et al. |
| 8,026,304 | B2 * | 9/2011 | Rajagopalan et al. ..... 524/322 |

(Continued)

OTHER PUBLICATIONS

Notification of Transmittal of the International Search Report and The Written Opinion of the International Searching Authority in connection with International Patent Application No. PCT/US2013/033967 mailed on Mar. 27, 2013; 7 pages.

(Continued)

*Primary Examiner* — Raeann Gorden
(74) *Attorney, Agent, or Firm* — Honigman Miller Schwartz and Cohn LLP

(57) ABSTRACT

Golf balls having one or more structural components that include a highly neutralized acid polymer with a high acid content and a uniformly increased density. The core of the golf ball may be made up of the highly neutralized acid polymer. The highly neutralized acid polymer may have desired hardness and flexural modulus values. The highly neutralized acid polymer enables the golf ball to provide consistent play characteristics.

18 Claims, 1 Drawing Sheet

(56) References Cited

U.S. PATENT DOCUMENTS

| | | | | |
|---|---|---|---|---|
| 8,075,423 | B2 * | 12/2011 | Sullivan et al. | 473/376 |
| 2002/0086745 | A1 | 7/2002 | Rajagopalan | |
| 2003/0144087 | A1 | 7/2003 | Rajagopalan et al. | |
| 2004/0186210 | A1 * | 9/2004 | Sullivan | A63B 37/0003 524/322 |
| 2005/0245690 | A1 | 11/2005 | Rajagopalan et al. | |
| 2007/0100085 | A1 | 5/2007 | Kim et al. | |
| 2008/0312007 | A1 | 12/2008 | Rajagopalan et al. | |
| 2009/0011858 | A1 | 1/2009 | Binette et al. | |
| 2009/0197704 | A1 | 8/2009 | Sullivan et al. | |
| 2010/0190576 | A1 | 7/2010 | Rajagopalan et al. | |
| 2010/0190578 | A1 | 7/2010 | Rajagopalan et al. | |
| 2011/0130220 | A1 | 6/2011 | Ichikawa et al. | |
| 2011/0244984 | A1 | 10/2011 | Harris et al. | |
| 2012/0004052 | A1 | 1/2012 | Chou et al. | |

OTHER PUBLICATIONS

Extended European Search Report dated Nov. 11, 2015 issued by the European Patent Office for EP 13768327.2 based on PCT/US2013/033967.

Office Action dated Jan. 20, 2016 for Korean Patent Application No. 10-2014-7029113, based on PCT/US2013/033967.

* cited by examiner

GOLF BALLS INCLUDING DENSE HIGH ACID LONOMERS

BACKGROUND

1. Field of the Invention

The present invention relates generally to golf balls. In particular, the present disclosure relates to the composition of a golf ball that includes a highly neutralized polymer having both a high acid content and a high density, without the use of density-adjusting fillers.

2. Description of Related Art

Modern golf balls are known to be made from a variety of polymer materials. The material making up a golf ball may affect the golf ball's performance characteristics in several ways. For example, the selection of the material for use as a golf ball may affect the golf ball's coefficient of restitution, initial velocity off the tee, feel, durability over time, and other properties.

Suitable known materials for use in a golf ball include thermoset materials, such as rubber, styrene butadiene, polybutadiene, isoprene, polyisoprene, and trans-isoprene. Known materials also include thermoplastics, such as ionomer resins, polyamides or polyesters, and thermoplastic polyurethane elastomers. Suitable materials also include polyurea compositions, as well as other materials.

In particular, ionomers are often used for to form the various structural components of known golf balls. For example, ionomers such as Surlyn™ available from E.I. DuPont de Nemours & Company are known to be used for cover layers of golf balls. Other types of ionomers, generally referred to as highly neutralized acid polymers, may also be used in golf balls.

Specifically, highly neutralized acid polymers are known to be used as the material for a golf ball core. For example, U.S. Pat. No. 6,756,436 to Rajagopalan et al., entitled "Golf Balls Comprising Highly-Neutralized Acid Polymers" and filed Apr. 9, 2002, discloses golf balls having highly neutralized acid polymer cores. The disclosure of this application is hereby incorporated by reference. Other conventional highly neutralized acid polymers are generally disclosed in U.S. Pat. No. 7,652,086 to Sullivan et al., entitled "Highly-neutralized Thermoplastic Copolymer Center for Improved Multi-layer Core Golf Ball" and filed Feb. 3, 2006, the disclosure of which is hereby incorporated by reference.

Certain formulations of the highly neutralized acid polymer may affect various physical properties of the polymer material, and so may affect the play characteristics of a golf ball made from that material. For example, U.S. Pat. No. 5,688,869 to Sullivan, entitled "Golf Ball Cover Compositions" and filed Jun. 21, 1995, discloses that highly neutralized acid polymers having high acid content (greater than 16% by weight) may achieve increased hardness, modulus, and resilience characteristics. These properties of high acid highly neutralized polymers may be advantageous to golf ball covers, cores, or other structural components, in order to achieve desired play characteristics.

Additionally, various additives and fillers may be added to a polymer composition in order to affect the material's properties. U.S. Pat. No. 7,402,114 to Binette et. al, entitled "Highly Neutralized Polymer Material with Heavy Mass Fillers for a Golf Ball" and filed on Jan. 15, 2007, discloses a golf ball with a layer formed from a highly neutralized polymer that has been weighted using density-adjusting fillers. Broadly, the fillers may be used to adjust the properties of the golf ball layer, reinforce the layer, or for any other purpose. As is generally known, fillers may be included in a polymer material making up a golf ball in order to change (for example) the weight or moment of inertia of a golf ball.

However, it is also known that highly neutralized acid polymers having high acid content may exhibit various disadvantages. For example, high acid content may result in the material having increased polarity, making the material less compatible with potential blend materials. U.S. Pat. No. 7,767,759 to Kim, entitled "Composition for Use in Golf Balls" and filed on Jul. 14, 2005, discuses this problem. The disclosure of U.S. Pat. No. 7,767,759 is hereby incorporated by reference. This problem, and other manufacturing difficulties associated with high acid content, are also discussed in U.S. Pub 2008/0312007 to Rajagopalan et al., entitled "Highly Neutralized Polymeric Composition for Golf Ball Layers" and filed on May 20, 2008, the disclosure of which is hereby incorporated by reference.

Such compatibility problems may result in golf ball layers that are less consistent and less uniform than may be desired. Namely, for example, such compatibility problems may result in an irregular dispersion of fillers in the polymer material. The golf ball manufactured from this material may accordingly exhibit play characteristics that are not highly consistent from shot to shot. Therefore, the use of fillers to control the weight or moment of inertia in a golf ball layer made from a highly neutralized polymer material may be difficult when the highly neutralized polymer has a high acid content.

Therefore, there exists a need in the art for highly neutralized acid polymer materials having a high acid content that allow for control over the various physical properties of the golf ball.

SUMMARY

In one aspect, this disclosure provides a golf ball comprising a core and a cover layer. The cover layer substantially surrounds the core. At least one of the core and the cover layer comprises a highly neutralized acid polymer. The highly neutralized acid polymer has an acid content of at least about 20%, and has a density of at least about 0.85 g/cm$^3$ prior to the inclusion of any density-adjusting fillers.

In another aspect, this disclosure provides a golf ball comprising: a core; and a cover layer, the cover layer substantially surrounding the core; wherein at least one of the core and the cover layer comprises a highly neutralized polymer; the highly neutralized polymer having an acid content of at least about 20%, and a density of at least about 0.85 g/cm$^3$ prior to the inclusion of any density-adjusting fillers in the highly neutralized polymer; and the at least one of the core and the cover layer comprising the highly neutralized polymer has a hardness that varies by less than about 5 Shore D between any two points on the flat hemispherical cross section of the at least one of the core and the cover layer.

In yet another aspect, this disclosure provides a golf ball comprising: a core; and a cover layer, the cover layer substantially surrounding the core; wherein the core comprises a highly neutralized polymer; the highly neutralized polymer having been neutralized to substantially 99% with a magnesium cation; the highly neutralized polymer having an acid content of at least about 20%, and a density of at least about 0.97 g/cm$^3$ prior to the inclusion of any density-adjusting fillers in the highly neutralized polymer; the core having a hardness that varies by less than about 3 Shore D between any two points on the flat hemispherical cross section of the core; the core having a flexural modulus of at least about 50,000 psi; the core having a surface Shore D hardness of at least about 50; and the core of the golf ball comprises less than about 0.5% by weight of density adjusting fillers.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
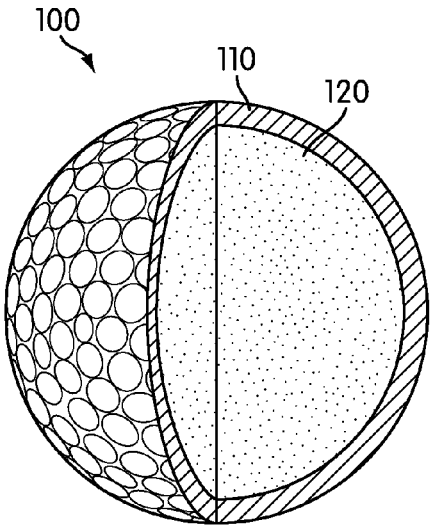
FIG. 1 shows a first representative golf ball in accordance with this disclosure, the golf ball being of a two-piece construction.

Generally, this disclosure relates to a golf ball that includes a particular ionomer polymer composition. The ionomer is a highly neutralized acid polymer having a high acid content. The highly neutralized acid polymer acid polymer has a desired density, without the substantial use of density-adjusting fillers. This desired density value may allow the highly neutralized polymer to affect the weight or moment of inertia (for example) of the golf ball, while also being highly uniform. As a result of this uniformity, the golf ball may exhibit highly consistent play characteristics.

As used herein, unless otherwise stated, certain material properties and golf ball properties are defined as follows.

The term "hardness" as used herein is measured generally in accordance with ASTM D-2240. The hardness of a material is taken as the slab hardness, while the hardness of a golf ball component is measured on the curved surface of the molded golf ball component. When a hardness measurement is made on a dimpled cover, hardness is measured on a land area of the dimpled cover. Hardness units are generally given in Shore D unless otherwise indicated.

The "coefficient of restitution" or "COR" is measured generally according to the following procedure: a test object is fired by an air cannon at an initial velocity of 40 m/sec, and a speed monitoring device is located over a distance of 0.6 to 0.9 meters from the cannon. After striking a steel plate positioned about 1.2 meters away from the air cannon, the test object rebounds through the speed-monitoring device. The return velocity divided by the initial velocity is the COR.

The "flexural modulus" is measured generally in accordance with ASTM D-790.

Except as otherwise discussed herein below, any golf ball discussed herein may generally be any type of golf ball known in the art. Namely, unless the present disclosure indicates to the contrary, a golf ball may generally be of any construction conventionally used for golf balls, such as a conforming or non-conforming construction. Conforming golf balls are golf balls which meet the Rules of Golf as approved by the United States Golf Association (USGA). Golf balls discussed herein may also be made of any of the various materials known to be used in golf ball manufacturing, except as otherwise noted.

Furthermore, it is understood that any feature disclosed herein (including but not limited to various embodiments shown in the FIGS. and various chemical formulas or mixtures) may be combined with any other features disclosed here, as may be desired, in any combination, subcombination, or arrangement.

An ionomer is generally understood as any polymer material that includes ionized functional groups therein. Ionomeric resins are often ionic copolymers of an olefin and a salt of an unsaturated carboxylic acid. The olefin may have from about 2 to about 8 carbon atoms, and may be an alpha-olefin. The acid may be an unsaturated monocarboxylic acid having from about 3 to about 8 carbon atoms, and may be an alpha, beta-unsaturated carboxylic acid. Commonly, ionomers are copolymers of ethylene and either acrylic acid or methacrylic acid. In some circumstances, an additional co-monomer (such as an acrylate ester, i.e., iso- or n-butylacrylate, etc.) can also be included to produce a terpolymer. A wide range of ionomers are known to the person of ordinary skill in the art of golf ball manufacturing.

When a large portion of the acid groups in the ionomer is neutralized by a cation, the ionomer material may be considered to be a highly neutralized acid polymer. Generally, such a polymer is considered highly neutralized when at least 70% of the acid groups are neutralized by a cation. In various embodiments, the highly neutralized acid polymer may be neutralized to at least 75%, at least 80%, at least 85%, at least 90%, at least 95%, at least 98%, at least 99%, or substantially 100%.

The acid content of a highly neutralized acid polymer is defined as the percentage of the unsaturated carboxylic acid by weight relative to the total weight of the polymer. Generally, the acid content may range from 1% to 50%. In particular embodiments where the highly neutralized acid polymer has a "high" acid content, the acid content may be at least about 20%. In various embodiments, the high acid content may be at least about 21%, at least about 22%, at least about 23%, at least about 24%, at least about 25%, at least about 26%, at least about 27%, at least about 28%, at least about 29%, at least about 30%, at least about 31%, at least about 32%, at least about 33%, at least about 34%, at least about 35%, at least about 36%, at least about 37%, at least about 38%, at least about 39%, at least about 40%, at least about 41%, at least about 42%, at least about 43%, at least about 44%, at least about 45%, at least about 46%, at least about 47%, at least about 48%, at least about 49%, or about 50%. Generally, higher acid levels may enable higher densities, as discussed herein below, but may also result in a loss of melt-processibility and related properties such as elongation and toughness. Namely, high acid levels may reduce any crystallinity otherwise present in the polymer. In particular embodiments, the high acid content may be greater than about 25%.

In various other embodiments, the high acid content may fall within a desired specific range. For example, in various embodiments, the high acid content may be from about 20% to about 40%, from about 25% to about 40%, from about 30% to about 40%, from about 35% to about 40%, or from about 38% to about 40%.

The presence of the high acid content may cause the highly neutralized acid polymer to exhibit certain material properties. For example, the high acid content may cause an increased hardness and an increased flexural modulus.

In particular, the flexural modulus of the highly neutralized acid polymer having a high acid content may be at least about 30,000 psi. The flexural modulus is measured in accordance with ASTM D-790, as is generally known in the art of golf ball manufacturing. In various embodiments, the flexural modulus may be at least about 10,000 psi, at least about 20,000 psi, at least about 30,000 psi, at least about 40,000 psi, at least about 50,000 psi, at least about 60,000 psi, at least about 70,000 psi, at least about 80,000 psi, at least about 90,000 psi, at least about 100,000 psi, at least about 110,000 psi, at least about 120,000 psi, at least about 130,000 psi, at least about 140,000 psi, or at least about 150,000. In other embodiments, the flexural modulus may be at least about 25,000 psi, at least about 50,000 psi, at least about 75,000 psi, at least about 100,000 psi, at least about 125,000 psi, or at least about 150,000 psi.

In other embodiments, the flexural modulus may be within a desired range. For example, the flexural modulus may generally be from about 30,000 psi to about 150,000. In various embodiments the flexural modulus may be from about 40,000 psi to about 150,000 psi, or from about 50,000 psi to about 150,000 psi, or from about 60,000 psi to about 150,000 psi, or from about 70,000 psi to about 150,000 psi, or from about 75,000 psi to about 150,000 psi, or from about 80,000 psi to about 150,000 psi, or from about 90,000 psi to about 150,000 psi, or from about 100,000 to about 150,000 psi, or from about 110,000 psi to about 150,000 psi, or from about 120,000 psi to about 150,000 psi, or from about 125,000 psi to about 150,000 psi, or from about 130,000 psi to about 150,000 psi, or from about 140,000 psi to about 150,000 psi.

A high flexural modulus (such as the above discussed ranges) may result in the golf ball component made from the material exhibiting increased stiffness, which may result in increased spin, among other desirable play characteristics. However, a flexural modulus of significantly greater than about 150,000 psi may be so stiff that undue cracking and other loss of durability may occur.

The highly neutralized acid polymer having a high acid content may also exhibit increased hardness. The material hardness of the highly neutralized acid polymer (as measured on a slab of material) may generally be at least about 50 Shore D. As mentioned above, hardness is generally measured in accordance with ASTM D-2240, as is generally known in the art of golf ball manufacturing. In various embodiments, the material hardness may be at least about 50 Shore D, at least about 55 Shore D, at least about 60 Shore D, at least about 65 Shore D, at least about 70 Shore D, at least about 75 Shore D, and at least about 80 Shore D.

In other embodiments, the material hardness may be within a desired range. For example, the material hardness may be from about 50 to about 80 Shore D. In various embodiments, the material hardness may be from about 55 to about 80 Shore D, or from about 60 to about 80 Shore D, or from about 65 to about 80 Shore D, or from about 70 to about 80 Shore D, or from about 75 to about 80 Shore D.

A high hardness (such as the above discussed ranges) may result in the golf ball made from the material exhibiting increased distance off the tee, or increased COR, among other desirable play characteristics. However, a golf ball having a layer comprising a material having a material hardness of more than 80 Shore D may be so hard that the golf ball exhibits poor "feel" to the golfer when hit by a driver.

The highly neutralized acid polymer is neutralized with a cation source. The nature of the cation source may affect the properties of the polymer material, and may be used to achieve advantageous effects. In particular, the highly neutralized acid polymer having a high acid content may be neutralized with a metal cation. Generally, a metal cation may originate from an organic acid or salt of an organic acid, an oxide, a hydroxide, or combinations thereof.

In embodiments where the metal cation source originates from a organic acid or salt thereof, the acid may be aliphatic organic acids, aromatic organic acids, saturated mono- or multi-functional organic acids, unsaturated mono- or multi-functional organic acids, and multi-unsaturated mono- or multi-functional organic acids. Salts of organic acids may be based on acetic acid, stearic acid, behenic acid, erucic acid, oleic acid, linoleic acid or dimerized derivatives thereof, or other fatty acids, and combinations thereof. Finally, the salt of an organic acid includes the cation itself.

The cation may be barium, lithium, sodium, zinc, bismuth, chromium, cobalt, copper, potassium, strontium, titanium, tungsten, magnesium, cesium, iron, nickel, silver, aluminum, tin, lead, calcium, and combinations thereof. For example, the cation may be $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, and combinations thereof.

In particular, the use of a metal cation to highly neutralize the acid groups in the high acid content ionomer may result in the polymer having an increased density as a result of at least four general factors:

(1) the ionomer contains a high acid content;

(2) the acid groups are highly neutralized;

(3) the metal cation used may have a large atomic weight;

(4) the ability for the metal cation source to fully neutralize as many acid groups in the polymer as possible.

The high acid content, such as from 20% to 40%, causes the polymer to include more total acid groups to which a cation may associate. The acid groups being highly neutralized, such as at least 70% or in particular about 98% or 99%, results in a greater fraction of the acid groups present in the polymer being associated with the metal cation. The atomic weight of the metal cation may also cause the polymer to have an increased density, so that each individual metal cation contributes more to the density of the polymer. Examples of metal cations having a large atomic weight may include zinc, sodium, magnesium, lead, tin, and others. Furthermore, different cations may differ in their abilities to fully neutralize as many acid groups in the polymer as possible as a result of various factors such as dispersibility, solubility, ionic dissociation energy, whether the ion is monovalent or divalent, and others.

As a result of the increase presence of a metal cation source, the density of the polymer may be at least about 0.85 $g/cm^3$. This density of 0.85 $g/cm^3$ is of the highly neutralized polymer, prior to the inclusion of any density-adjusting fillers. In various embodiments, the density of the highly neutralized polymer having a high acid content may be at least about 0.88 $g/cm^3$, at least about 0.90 $g/cm^3$, at least about 0.92 $g/cm^3$, at least about 0.95 $g/cm^3$, at least about 0.97 $g/cm^3$, at least about 0.98 $g/cm^3$, at least about 0.99 $g/cm^3$, at least about 1.00 $g/cm^3$, at least about 1.02 $g/cm^3$, at least about 1.05 $g/cm^3$, at least about 1.08 $g/cm^3$, at least about 1.10 $g/cm^3$.

In other embodiments, the density may be within a desired range. For example, the density may be from about 0.85 g/cm$^3$ to about 1.10 g/cm$^3$, from about 0.88 g/cm$^3$ to about 1.10 g/cm$^3$, from about 0.90 g/cm$^3$ to about 1.10 g/cm$^3$, from about 0.92 g/cm$^3$ to about 1.10 g/cm$^3$, from about 0.95 g/cm$^3$ to about 1.10 g/cm$^3$, from about 0.97 g/cm$^3$ to about 1.10 g/cm$^3$, from about 0.98 g/cm$^3$ to about 1.10 g/cm$^3$, from about 0.99 g/cm$^3$ to about 1.10 g/cm$^3$, from about 1.00 g/cm$^3$ to about 1.10 g/cm$^3$, from about 1.05 g/cm$^3$ to about 1.10 g/cm$^3$, or from about 1.08 g/cm$^3$ to about 1.10 g/cm$^3$. In one particular embodiment, the density may be from about 0.85 g/cm$^3$ to about 0.98 g/cm$^3$.

Furthermore, the above discussed increased density may be achieved with a high degree of uniformity throughout the polymer material. Without wishing to be bound by any particular theory of action, it is believed that the highly uniform density may be achieved as a result of the large amount of metal cations present throughout the highly neutralized acid polymer having a high acid content. This highly uniform density may be achieved without the use of density-adjusting fillers. Such fillers are generally incapable of achieving good enough dispersion in the polymer material to achieve the desired highly uniform density. This poor dispersion may be the result of, for example, compatibility issues (as mentioned above), as well as the result of the various limitations of physical mixing processes.

In particular embodiments, this uniformity may be measured as the difference in hardness between any two points on the flat hemispherical cross-section of the polymer material in a golf ball, namely the flat surface of a golf ball structural component that has been cut in half into a cross section. For example, the hardness may vary by less than about 5 Shore D between any two points on the flat hemispherical cross-section. In other embodiments, the hardness may vary by less than about 3 Shore D between any two points on the flat hemispherical cross-section. Finally, in yet other embodiments, the hardness may vary by less than about 1 Shore D between any two points on the flat hemispherical cross-section.

Density-adjusting fillers are well known in the art of golf ball manufacturing. Generally, a filler may be considered density-adjusting when the density of the filler is sufficiently different than the density of the polymer to measurably affect the density of the total composition. In particular, many common density-adjusting fillers are used to increase the density of a polymer. For example, examples of density-adjusting fillers that increase density include various metals such as titanium, tungsten, aluminum, bismuth, nickel, molybdenum, iron, steel, lead, copper, brass, boron, boron carbide whiskers, bronze, cobalt, beryllium, zinc, tin; metal oxides including zinc oxide, iron oxide, aluminum oxide, titanium oxide, magnesium oxide, zirconium oxide; and metal stearates including zinc stearate, calcium stearate, barium stearate, lithium stearate, magnesium stearate. Other known density-adjusting fillers include limestone, ground flash filler, precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates, metals, metal alloys, tungsten carbide, particulate carbonaceous materials, and combinations thereof.

Other fillers that may commonly be used in polymers, but which are generally not considered density-adjusting, include: UV absorbers, antioxidants, antistatic agents, stabilizers, and plasticizers.

Generally, the above-discussed highly neutralized acid polymer having a high acid content and a high density may be incorporated into any structural component of a golf ball. FIGS. 1-4 show various embodiments of several golf ball in accordance with this disclosure. In various embodiments, any one structural component of the golf ball may comprise the highly neutralized acid polymer having a high acid content and a desired density, or any combination or sub-combination of structural components may comprise highly neutralized acid polymer having a high acid content and a desired density.

FIG. 1 shows a first golf ball 100 having aspects in accordance with this disclosure. Golf ball 100 is a two-piece golf ball. Specifically, golf ball 100 includes cover layer 110 substantially surrounding core 120. In some embodiments of golf ball 100, core 120 may comprise the highly neutralized acid polymer having a high acid content and a desired density. In other embodiments of golf ball 100, cover layer 110 may comprise the highly neutralized acid polymer having a high acid content and a desired density.

Figure 2:
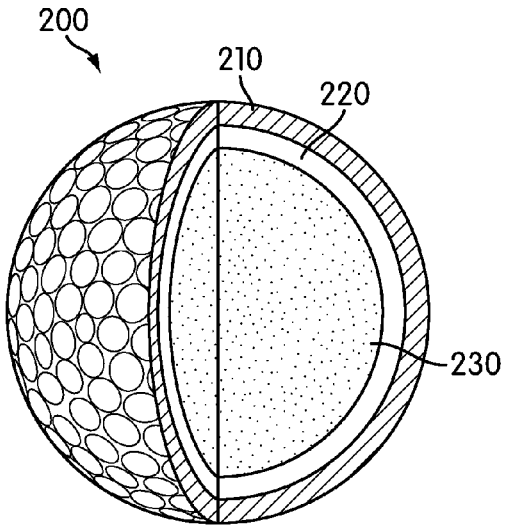
FIG. 2 shows a second representative golf ball, having an inner cover layer and an outer cover layer.

FIG. 2 shows a second golf ball 200 having aspects in accordance with this disclosure. Golf ball 200 includes a core 230, an inner cover layer 220 substantially surrounding core 230, and an outer cover layer 210 substantially surrounding inner cover 220. In some embodiments of golf ball 200, core 230 may comprise the highly neutralized acid polymer having a high acid content and a desired density. In other embodiments of golf ball 200, either or both of inner cover layer 220 and outer cover layer 210 may comprise the highly neutralized acid polymer having a high acid content and a desired density.

Figure 3:
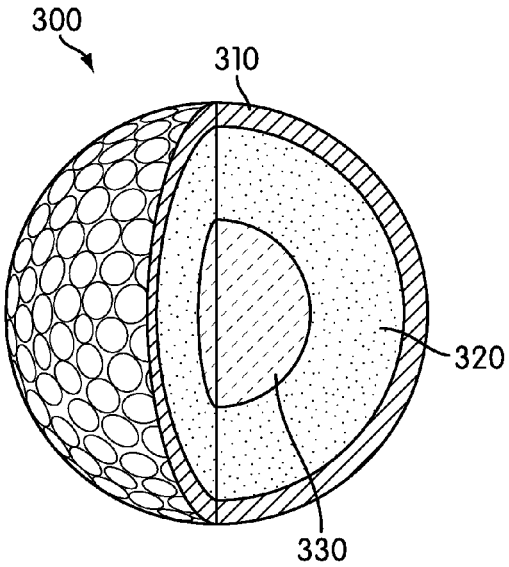
FIG. 3 shows a third representative golf ball, having an inner core and an outer core.

FIG. 3 shows a third golf ball 300 having aspects in accordance with this disclosure. Golf ball 300 includes an inner core 330, an outer core 320 substantially surrounding inner core 330, and a cover layer 310 substantially surrounding outer core layer 320. In embodiments such as shown in FIG. 3, where the golf ball includes multiple core layers, either or both of inner core 330 and outer core 320 may comprise the highly neutralized acid polymer having a high acid content and a desired density. In other embodiments, cover layer 310 may comprise the highly neutralized acid polymer having a high acid content and a desired density.

Generally, the term "core" as used herein refers to at least one of the innermost structural components of the golf ball. The term core may therefore refer to (1) inner core 330 only, (2) both inner core 330 and outer core 320 collectively, or (3) outer core 320 only. The term core may also encompass more than two layers if, for example, an additional structural layer is present between inner core 330 and outer core 320 or encompassing outer core 320. A layer such as outer core 320 may also sometimes be referred to as a mantle layer in the golf ball art.

Figure 4:
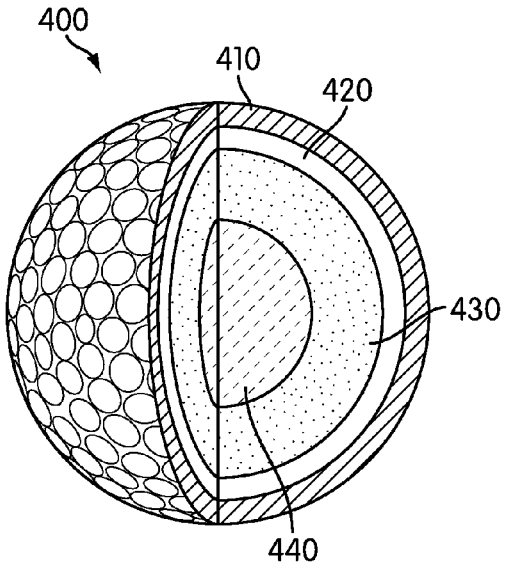
FIG. 4 shows a fourth representative golf ball, having an inner core, an outer core, an inner cover layer, and an outer cover layer.

FIG. 4 shows a fourth golf ball 400 having aspects in accordance with this disclosure. Golf ball 400 is a four-piece golf ball. Golf ball 400 includes an inner core layer 440, an outer core layer 430 substantially surrounding inner core layer 440, an inner cover layer 420 substantially surrounding outer core layer 430, and an outer cover layer 410 substantially surrounding inner cover layer 420. As with FIG. 3, in embodiments such as shown in FIG. 4, either or both of inner core 440 and outer core 430 may comprise the highly neutralized acid polymer having a high acid content and a desired density. Furthermore, as with FIG. 2, either or both of inner cover layer 420 and outer cover layer 440 may also comprise the highly neutralized acid polymer having a high acid content and a desired density.

In some embodiments, any structural component that comprises the highly neutralized acid polymer having a high acid content and a desired density may also include any other material that may be suitable for golf ball construction. For example, the highly neutralized acid polymer may be mixed with a second polymer, or any of various known additives may be added to the highly neutralized acid polymer. However, in some embodiments the structural component of the golf ball comprising the highly neutralized acid polymer may include less than about 1% by weight of density-adjusting fillers, or less than about 0.5% by weight density-adjusting fillers, or less than about 0.1% by weight density-adjusting fillers.

Also, any structural component of the golf ball mentioned above may consist essentially of the highly neutralized acid polymer. A polymer material may be considered to consist essentially of the highly neutralized acid polymer when no other polymeric materials are present in any measurable amounts. Furthermore, any structural component of the golf ball may consist of the highly neutralized acid polymer, in that no other materials of any type are present in any measureable amounts.

The various structural components of the golf ball comprising the highly neutralized acid polymer may exhibit the material properties discussed above (such as flexural modulus, hardness, and uniformity of hardness), in the values as mentioned.

As a result of the above discussed uniformity of increased density, the golf ball comprising the highly neutralized acid polymer may achieve desirable play characteristics. Namely, the increased density of the highly neutralized polymer may affect the weight or moment of inertia (for example) of the golf ball, while also being highly uniform. As a result of this uniformity, the golf ball may exhibit highly consistent play characteristics.

Ideally, a golf ball should exhibit identical play characteristics in response to identical shot conditions. Generally, the more uniform the polymer materials making up the golf ball, the more consistent the golf ball's play characteristics will be. However, materials making up convention golf balls may not be uniform to a high degree, for the reasons discussed various above. In contrast, the highly neutralized acid polymer with uniform density does not include irregularities that might affect how the play characteristics vary in response shot conditions.

A golf ball made from the highly neutralized acid polymer with uniform increased density will therefore provide substantially identical play characteristics in response to identical shot characteristics. Furthermore, such a golf ball will also be more "forgiving" of any variance in shot conditions. Namely, the play characteristics should vary to only a small degree in response to any variance in the shot conditions. In particular, these advantages may be achieved in some embodiments when the core of the golf ball comprises the highly neutralized acid polymer with uniform increased density.

Specifically, in one embodiment, the golf ball may exhibit a predetermined play characteristic in response to being hit by a golf club under a predetermined stroke condition, wherein the play characteristic varies in value by less than about 1% for each 1% by which the stroke condition varies in value. A play characteristic may generally be any aspect of how the golf ball behaves after being hit. For example, the play characteristic may be: initial velocity, initial spin, or total distance. A shot characteristic may generally be any aspect of how the golfer hits the golf ball. The shot characteristic may be, for example, swing speed, angle of attack (i.e., approach angle), or face angle (i.e., angle by which the club face is open or closed).

Accordingly, the highly neutralized acid polymer allows a golf ball to achieve improved play characteristics with greater consistency.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A two-piece golf ball consisting of:

a core; and a cover layer substantially surrounding the core;

wherein the core consists essentially of highly neutralized acid polymer having an acid content of at least about 41%, and having a density of at least about 0.85 g/cm$^3$, wherein the golf ball is a conforming golf ball.

2. The golf ball according to claim 1, wherein the highly neutralized acid polymer has a density that is at least about 0.97 g/cm$^3$.

3. The golf ball according to claim 1, wherein the highly neutralized acid polymer has a density of from about 0.85 to about 0.98 g/cm$^3$.

4. The golf ball according to claim 1, wherein the highly neutralized acid polymer is neutralized with a metal cation.

5. The golf ball according to claim 1, wherein the highly neutralized acid polymer is neutralized with a magnesium cation.

6. The golf ball according to claim 1, wherein the highly neutralized acid polymer is neutralized with magnesium acetate.

7. A golf ball according to claim 1, wherein the core has a hardness that varies by less than about 5 Shore D between any two points on a flat hemispherical cross section of of the core.

8. The golf ball according to claim 7, wherein the highly neutralized acid polymer has a flexural modulus of at least about 75,000 psi.

9. The golf ball according to claim 7, wherein the highly neutralized acid polymer has a Shore D material hardness of at least about 65.

10. The golf ball according to claim 7, wherein the core has a hardness that varies by less than about 3 Shore D between any two points on the flat hemispherical cross section of the core.

11. The golf ball according to claim 7, wherein the core has a hardness that varies by less than about 1 Shore D between any two points on the flat hemispherical cross section of the core.

12. The golf ball according to claim 7, wherein the golf ball exhibits a predetermined play characteristic in response to being hit by a golf club under a predetermined shot characteristic, wherein the play characteristic varies in value by less than about 1% for each 1% by which the shot characteristic varies in value.

13. The golf ball according to claim 12, wherein the play characteristic is selected from the group consisting of: initial velocity, initial spin, and total distance.

14. The golf ball according to claim 12, wherein the shot characteristic is selected from the group consisting of: swing speed, angle of attack, and face angle.

15. A golf ball according to claim 1, wherein the highly neutralized acid polymer is neutralized to substantially 99% with a magnesium cation and has a density of at least about 0.97 g/cm$^3$;

the core having a hardness that varies by less than about 3 Shore D between any two points on a flat hemispherical cross section of the core;

the core having a flexural modulus of at least about 50,000 psi; and the core having a surface Shore D material hardness of at least about 50.

16. A golf ball according to claim 1, wherein the highly neutralized acid polymer has an acid content of at least 42%.

17. A golf ball according to claim 1, wherein the highly neutralized acid polymer has an acid content of at least 44%.

18. A golf ball according to claim 1, wherein the highly neutralized acid polymer has an acid content of at least 46%.

* * * * *